US012264384B2

(12) United States Patent
Iwayama et al.

(10) Patent No.: US 12,264,384 B2
(45) Date of Patent: Apr. 1, 2025

(54) COMPOSITE MATERIAL

(71) Applicant: A.L.M.T. Corp., Tokyo (JP)

(72) Inventors: Isao Iwayama, Osaka (JP); Ryota Matsugi, Osaka (JP); Takahiro Nishimizu, Sakata (JP)

(73) Assignee: A.L.M.T. CORP., Tokyo (JP)

( * ) Notice: Subject to any disclaimer, the term of this patent is extended or adjusted under 35 U.S.C. 154(b) by 811 days.

(21) Appl. No.: 17/598,990

(22) PCT Filed: Mar. 13, 2020

(86) PCT No.: PCT/JP2020/011138
§ 371 (c)(1),
(2) Date: Sep. 28, 2021

(87) PCT Pub. No.: WO2020/203185
PCT Pub. Date: Oct. 8, 2020

(65) Prior Publication Data

US 2022/0186347 A1 Jun. 16, 2022

(30) Foreign Application Priority Data

Mar. 29, 2019 (JP) ..... 2019-065969

(51) Int. Cl.
*C22C 1/10* (2023.01)
*C22C 26/00* (2006.01)
(Continued)

(52) U.S. Cl.
CPC ..... *C22C 26/00* (2013.01); *C22C 1/10* (2013.01); *C22C 29/065* (2013.01); *C22C 47/08* (2013.01)

(58) Field of Classification Search
CPC ..... C22C 1/10; C22C 47/08
See application file for complete search history.

(56) References Cited

U.S. PATENT DOCUMENTS 6,031,285 A 2/2000 Nishibayashi
2006/0052249 A1* 3/2006 Schedler ..... C04B 37/026 505/325
(Continued)

FOREIGN PATENT DOCUMENTS

CN 101649400 A 2/2010
JP 2006-77327 A 3/2006
(Continued)

*Primary Examiner* — Alexandra M Moore
(74) *Attorney, Agent, or Firm* — Faegre Drinker Biddle & Reath LLP

(57) ABSTRACT

A composite material contains a metallic phase, a non-metallic phase and a specific element. At least 90 mass % of the metallic phase is composed of at least one selected from the group consisting of Ag and Cu. The non-metallic phase includes a coated core material. The coated core material includes a core material and a carbide layer that covers at least a part of a surface of the core material. The core material contains at least one carbon-containing material selected from the group consisting of diamond, graphite, carbon fibers, and silicon carbide. The carbide layer contains a carbide of at least one metal element selected from the group consisting of Ti, Cr, Ta, and V. The specific element is at least one selected from the group consisting of Y and Mg. A total content of the specific element is 0.0004 mass % to 1.3 mass %.

7 Claims, 2 Drawing Sheets

(51) Int. Cl.
*C22C 29/06* (2006.01)
*C22C 47/08* (2006.01)

(56) References Cited

U.S. PATENT DOCUMENTS

| | | | | |
|---|---|---|---|---|
| 2006/0157884 | A1* | 7/2006 | Ludtke | C22C 21/02 423/446 |
| 2010/0319900 | A1 | 12/2010 | Abyzov | |
| 2015/0218676 | A1 | 8/2015 | Nakamura et al. | |
| 2016/0336253 | A1 | 11/2016 | Fukui | |
| 2017/0145280 | A1* | 5/2017 | Morikawa | H01L 23/3732 |
| 2020/0370146 | A1 | 11/2020 | Matsugi et al. | |

FOREIGN PATENT DOCUMENTS

| | | | | |
|---|---|---|---|---|
| JP | 2017-95766 | A | 6/2017 | |
| WO | WO-2011049479 | A1 * | 4/2011 | C22C 26/00 |
| WO | WO-2014/038459 | A1 | 3/2014 | |
| WO | WO-2016/035795 | A1 | 3/2016 | |
| WO | WO-2019/163721 | A1 | 8/2019 | |

* cited by examiner

COMPOSITE MATERIAL

TECHNICAL FIELD

The present disclosure relates to a composite material.

The present application claims priority to Japanese Patent Application No. 2019-065969 filed on Mar. 29, 2019, the entire contents of which are herein incorporated by reference.

BACKGROUND ART

PTL 1 discloses a composite material containing silver and diamond as constituent materials of a heat radiation member of a semiconductor element.

CITATION LIST

Patent Literature

PTL 1: WO2016/035795

SUMMARY OF INVENTION

A composite material according to the present disclosure contains a metallic phase and a non-metallic phase and further contains a specific element. At least 90 mass % of the metallic phase is composed of at least one selected from the group consisting of Ag and Cu. The non-metallic phase includes a coated core material. The coated core material includes a core material and a carbide layer that covers at least a part of a surface of the core material. The core material contains at least one carbon-containing material selected from the group consisting of diamond, graphite, carbon fibers, and silicon carbide. The carbide layer contains a carbide of at least one metal element selected from the group consisting of Ti, Cr, Ta, and V. The specific element is at least one selected from the group consisting of Y, Mg, Si, B, and Zr. A total content of the specific element is not lower than 0.0004 mass % and not higher than 1.3 mass %.

DETAILED DESCRIPTION

Figure 1:
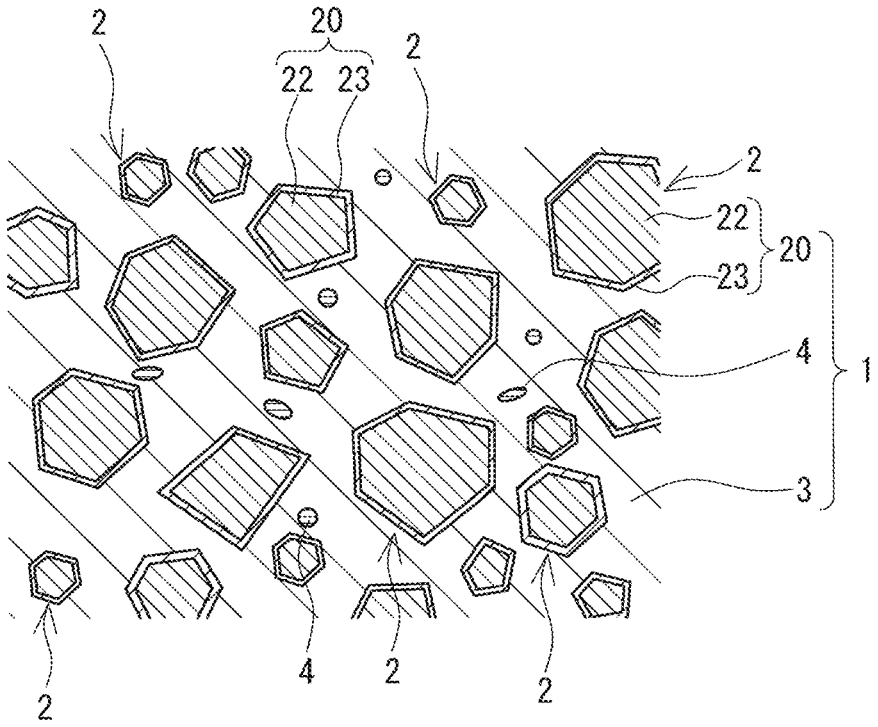
FIG. 1 is a partial cross-sectional view schematically illustrating a composite material in an embodiment.

Problem to be Solved by the Present Disclosure

A heat radiation member made of a composite material composed of silver and diamond described above in PTL 1 has high thermal conductivity even after repeatedly performed hot-cold heat cycles. Furthermore, a heat radiation member having high thermal conductivity without variation in thermal conductivity even after repeatedly performed hot-cold heat cycles, that is, a heat radiation member having high thermal conductivity in a stable manner, is desirable.

One of objects of the present disclosure is to provide a composite material of which a heat radiation member with high thermal conductivity in a stable manner even after repeatedly performed hot-cold heat cycles can be constructed.

SUMMARY OF EMBODIMENT

Contents of an embodiment of the present disclosure will initially be listed and described.

(1) A composite material according to one aspect of the present disclosure contains a metallic phase and a non-metallic phase and further contains a specific element. At least 90 mass % of the metallic phase is composed of at least one selected from the group consisting of Ag and Cu. The non-metallic phase includes a coated core material. The coated core material includes a core material and a carbide layer that covers at least a part of a surface of the core material. The core material contains at least one carbon-containing material selected from the group consisting of diamond, graphite, carbon fibers, and silicon carbide. The carbide layer contains a carbide of at least one metal element selected from the group consisting of Ti, Cr, Ta, and V. The specific element is at least one selected from the group consisting of Y, Mg, Si, B, and Zr. A total content of the specific element is not lower than 0.0004 mass % and not higher than 1.3 mass %.

A heat radiation member with high thermal conductivity can be constructed of the composite material in the present disclosure, for reasons below.

(a) The metallic phase is mainly composed of a metal element with high thermal conductivity. The metal element is at least one of Ag and Cu.

(b) The composite material in the present disclosure contains as the non-metallic phase, a carbon-containing material with high thermal conductivity such as diamond.

(c) The carbide layer composed of a carbide of Ti or the like is present at a surface of the carbon-containing material such as diamond. The metallic phase and the non-metallic phase are in intimate contact with each other owing to the carbide layer. The composite material in the present disclosure is hence excellent in heat conduction property between the metallic phase and the non-metallic phase.

(d) A specific element such as Y is contained, and a content of the specific element satisfies the specific range described above. Therefore, the composite material in the present disclosure is less likely to experience lowering in thermal conductivity due to the contained specific element.

The composite material in the present disclosure is less in lowering in thermal conductivity and high in thermal conductivity in a stable manner even after repeatedly performed hot-cold heat cycles, because the composite material in the present disclosure can well maintain a state of intimate contact between the metallic phase and the non-metallic phase owing to the carbide layer described above even after repeatedly performed hot-cold heat cycles. One of reasons why the state of intimate contact can be maintained may be as below.

In a process for manufacturing a composite material, an oxide film may be present at a surface of a metal element such as Ti employed as a source material of the carbide layer described above. Ag or Cu which is a main component of the metallic phase or carbon contained in the carbon-containing material is unable to reduce the oxide film. Therefore, when a surface of a powder particle composed of a metal element employed as the source material is completely covered with the oxide film, the particle is unable to react with carbon to form a carbide layer. Powders composed of the metal element are expected to include such particles completely covered with the oxide film (which are called oxidized particles below) at a certain ratio. In addition, a content of oxidized particles in powders is varied. Such variation in source material may be a cause of variation in characteristics of the composite material. In contrast, as will be described later, the specific element such as Y functions as a reducing agent for the oxide film. The metal element and carbon can react with each other owing to this reduction function, and the carbide layer can appropriately be formed. As the carbide layer is formed at the surface of the carbon-containing material, the carbon-containing material is wetted well with a metal in a molten state (a metal to be a source material of the metallic phase). Therefore, the metallic phase and the non-metallic phase are in intimate contact with each other. Such a composite material including a large number of portions in intimate contact may tend to readily maintain the state of intimate contact even when it is subjected to repeatedly performed hot-cold heat cycles.

A heat radiation member with high thermal conductivity in a stable manner even after repeatedly performed hot-cold heat cycles can be constructed of the composite material in the present disclosure. The carbon-containing material described above is sufficiently smaller in coefficient of linear expansion than Ag and Cu. Therefore, the composite material in the present disclosure is excellent in compatibility in coefficient of linear expansion with a semiconductor element or the like. Therefore, the composite material in the present disclosure can be suitable for a constituent material of a heat radiation member of a semiconductor element.

(2) An example embodiment of the composite material in the present disclosure may contain at least some of the specific element as an oxide.

In the embodiment, the specific element such as Y described above is present as an oxide. Therefore, the specific element is considered as having been able to reduce a metal element such as Ti in a process for manufacturing the composite material, thereby appropriately forming the carbide layer from the metal element.

Consequently, the metallic phase and the non-metallic phase can more reliably be in intimate contact with each other owing to the carbide layer. A content of the oxide is dependent on a content of the specific element. Therefore, in the embodiment, the oxide is not excessively contained and lowering in thermal conductivity due to excessively contained oxide is less likely. Therefore, according to the embodiment, the heat radiation member with high thermal conductivity in a stable manner even after repeated hot-cold heat cycles can more reliably be constructed.

(3) In one embodiment of the composite material in the present disclosure, a total content of the metal element may be not lower than 0.1 mass % and not higher than 7.5 mass %.

In the embodiment, the content of the metal element such as Ti satisfies the range, and hence the metal element can appropriately be contained as the carbide layer. In the embodiment, lowering in thermal conductivity due to excessively contained metal element is less likely. Therefore, according to the embodiment, the heat radiation member with higher thermal conductivity can readily be constructed.

(4) In one embodiment of the composite material in the present disclosure, a content of the non-metallic phase may be not lower than 50 volume %.

According to the embodiment, a large amount of carbon-containing material with high thermal conductivity is contained. Therefore, according to the embodiment, the heat radiation member with higher thermal conductivity could readily be constructed.

(5) In one embodiment of the composite material in the present disclosure, a content of the non-metallic phase may be not lower than 50 volume % and not higher than 90 volume %.

When the content of the non-metallic phase is not higher than 90 volume %, the composite material contains the metallic phase to some extent (at least 10 volume %). The metallic phase can bond particles that form the non-metallic phase to each other or can bury cavities in a porous body that forms the non-metallic phase. The metallic phase can prevent the coefficient of linear expansion of the composite material from becoming excessively small. Since the non-metallic phase is not excessive, the core material as a source material of the non-metallic phase is readily infiltrated with a source material metal in a molten state in the manufacturing process. Therefore, production of an uninfiltrated portion is suppressed and the composite material tends to more reliably be dense.

(6) In one embodiment of the composite material in the present disclosure, the composite material may contain at least some of the specific element as an oxide, a total content of the metal element may be not lower than 0.1 mass % and not higher than 7.5 mass %, and a content of the non-metallic phase may be not lower than 50 volume % and not higher than 90 volume %.

Advantageous Effect of the Present Disclosure

A heat radiation member with high thermal conductivity in a stable manner even after repeatedly performed hot-cold heat cycles can be constructed of the composite material in the present disclosure.

DESCRIPTION OF EMBODIMENT

An embodiment of the present disclosure will specifically be described below with reference to the drawings as appropriate. The same elements in the drawings have the same reference characters allotted.

[Composite Material]

A composite material 1 in an embodiment will be described mainly with reference to FIG. 1.

(Overview)

A composite material 1 in the embodiment contains a metallic phase 3 and a non-metallic phase 2 as illustrated in FIG. 1. Metallic phase 3 is mainly composed of silver (Ag), copper (Cu), or both of Ag and Cu. Non-metallic phase 2 includes a coated core material 20. Coated core material 20 includes a core material 22 and a carbide layer 23 that covers at least a part of a surface of core material 22. A constituent material of core material 22 includes a carbon-containing material such as diamond (details of which will be described later). A constituent material of carbide layer 23 contains a carbide of a metal element such as Ti (details of which will be described later). Composite material 1 is representatively in a form of a flat plate and used for a heat radiation member of a semiconductor element or the like.

Composite material 1 in the embodiment further contains a specific element. Specifically, composite material 1 contains at least 4 mass ppm and at most 1.3 mass of at least one element (specific element) selected from the group consisting of yttrium (Y), magnesium (Mg), silicon (Si), boron (B), and zirconium (Zr) in total, with composite material 1 being defined as 100 mass %. The specific element contributes to appropriate formation of carbide layer 23 in a process for manufacturing composite material 1. In composite material 1, non-metallic phase 2 and metallic phase 3 are in intimate contact with each other with carbide layer 23 being interposed, and a state of intimate contact tends to be maintained even after repeatedly performed hot-cold heat cycles.

Detailed description will be given below for each constituent element.

(Non-Metallic Phase)

<Main Constituent Material>

Composite material 1 in the embodiment contains at least one carbon-containing material selected from the group consisting of diamond, graphite, carbon fibers, and silicon carbide as non-metallic phase 2. In other words, core material 22 includes at least one carbon-containing material selected from the group consisting of diamond, graphite, carbon fibers, and silicon carbide. These carbon-containing materials are each sufficiently smaller in coefficient of linear expansion than Ag and Cu, while they have high thermal conductivity. Therefore, composite material 1 is excellent in compatibility in coefficient of linear expansion with a component of a semiconductor device such as a semiconductor element, an insulating substrate, or a package. Composite material 1 can be suitable for a constituent material of a heat radiation member of a semiconductor element. The carbon-containing materials are each excellent in heat resistance. Therefore, the heat radiation member excellent in heat resistance can be constructed of composite material 1.

Diamond representatively has high thermal conductivity not lower than 1000 W/m·K. Diamond is substantially free from anisotropy in heat conduction. Therefore, when diamond is contained as non-metallic phase 2, composite material 1 is excellent in heat conduction property. Graphite is excellent in mechanical workability. Though graphite has anisotropy in heat conduction, it is more inexpensive than diamond and manufacturing cost can be reduced. Therefore, graphite is easy to use. Carbon fibers are similar to graphite, however, they are not cleaved. Therefore, composite material 1 containing carbon fibers as non-metallic phase 2 is higher in strength than the composite material containing graphite. Composite material 1 containing carbon fibers having very high thermal conductivity as high as approximately 2000 W/mK in a longitudinal direction of fibers is higher in heat conduction property. Silicon carbide is lower in thermal conductivity than diamond, however, it is free from anisotropy in heat conduction and additionally it is more inexpensive than diamond. From these aspects, silicon carbide is easy to use.

Composite material 1 in the embodiment may contain one carbon-containing material or at least two carbon-containing materials as non-metallic phase 2. In particular, composite material 1 containing diamond as non-metallic phase 2 is preferred because a heat radiation member with high thermal conductivity can be constructed thereof. When the composite material contains at least one carbon-containing material selected from the group consisting of graphite, carbon fibers, and silicon carbide in addition to diamond as non-metallic phase 2, a heat radiation member with high thermal conductivity can be constructed with low cost.

<Form of Presence>

Non-metallic phase 2 may contain particles as illustrated in FIG. 1. Particles that form non-metallic phase 2 are dispersed in metallic phase 3. Substantially the entirety of non-metallic phase 2 may be formed from particles. Alternatively, non-metallic phase 2 may contain a porous body (not shown) of a three-dimensionally networked structure. In this case, metallic phase 3 is filled in the pores of the porous body. Examples of the porous body include a sintered material composed of silicon carbide.

Non-metallic phase 2 includes coated core material 20. Coated core material 20 includes core material 22 and carbide layer 23. Carbide layer 23 is a thin film that covers at least a part or preferably substantially the entirety of a surface of core material 22. Though FIG. 1 illustrates carbide layer 23 having a large thickness for facilitated understanding, carbide layer 23 is actually very small in thickness. Substantially the entirety of non-metallic phase 2 may be formed of coated core material 20, because composite material 1 is excellent in heat conduction property owing to intimate contact between non-metallic phase 2 and metallic phase 3 as will be described later.

Examples of coated core material 22 include coated particles in which core material 22 is made from particles composed of the carbon-containing material. FIG. 1 illustrates coated particles as coated core material 20. FIG. 1 illustrates an example in which non-metallic phase 2 is made from coated particles. Specific examples of coated particles include such coated particles that core material 22 is composed of diamond and carbide layer 23 is composed of TiC. Examples of other coated core materials include a coated porous body in which core material 22 is made from the porous body described above. Composite material 1 may contain both of the coated particles described above and the coated porous body as coated core material 20.

Examples of a constituent material of core material 22 include a non-metal inorganic material such as the carbon-containing material described above. Examples of the constituent material of carbide layer 23 include a carbide containing at least one metal element selected from the group consisting of titanium (Ti), chromium (Cr), tantalum (Ta), and vanadium (V). In other words, carbide layer 23 contains a carbide of at least one metal element selected from the group consisting of Ti, Cr, Ta, and V.

<Carbide>

Carbide layer 23 contributes to enhanced wettability of a core material 21 with a molten metal employed as a source material for metallic phase 3 (which may be called a source material metal 30 (FIG. 2) below). As wettability is enhanced, production of a portion where a gap between coated core materials 20 is not infiltrated with the molten metal (an uninfiltrated portion) can be suppressed and composite material 1 tends to be dense. Core material 22 that forms non-metallic phase 2 and metallic phase 3 are in intimate contact with each other owing to carbide layer 23. Carbon (C) that forms a carbide is representatively derived from a carbon-containing material such as diamond. Therefore, core material 22 composed of the carbon-containing material and carbide layer 23 are in intimate contact with each other. Owing to intimate contact between non-metallic phase 2 and metallic phase 3 and intimate contact between core material 22 and carbide layer 23, dense composite material 1 is excellent in heat conduction property between non-metallic phase 2 and metallic phase 3 and high in thermal conductivity.

In particular, a carbide containing at least one metal element of Ti and Cr is preferred in aspects below.

(1) The carbide is excellent in wettability with metallic phase 3 mainly composed of Ag or Cu.

(2) Even when Ti and Cr are dissolved as a solid solution in Cu or the like that forms metallic phase 3, Ti and Cr are precipitated from Cu or the like by performing appropriate heat treatment (aging). Therefore, composite material 1 is less likely to be low in thermal conductivity even when it contains Ti or Cr in an amount large to some extent.

(3) When composite material 1 contains Ti or Cr in an amount large to some extent, mechanical strength of composite material 1 tends to be higher.

The carbide may contain at least two metal elements selected from the group consisting of Ti, Cr, V, and Ta.

A total content of the metal element such as Ti may be, for example, not lower than 0.1 mass % and not higher than 7.5 mass %, with composite material 1 being defined as 100 mass %.

When the content of the metal element such as Ti is not lower than 0.1 mass %, carbide layer 23 composed of the metal element as the constituent material can appropriately be present. In addition, an area covered with carbide layer 23 at the surface of core material 22 can be large. Preferably, the entire surface of core material 22 is covered with carbide layer 23. Such composite material 1 has been able to satisfactorily become denser or to satisfactorily make a composite, because wettability of core material 21 (FIG. 2) as the source material with source material metal 30 in the molten state is enhanced in the manufacturing process as described above. Therefore, composite material 1 tends to maintain a state of intimate contact between non-metallic phase 2 and metallic phase 3 with carbide layer 23 being interposed therebetween even after repeatedly performed hot-cold heat cycles. When increase in area covered with carbide layer 23 is desired, the content may be not lower than 0.3 mass % or furthermore not lower than 0.5 mass %.

When the content of the metal element such as Ti is not higher than 7.5 mass %, carbide layer 23 composed of the metal element as the constituent material is less likely to be excessively large in amount or thickness. Preferably, carbide layer 23 tends to be very small and uniform in thickness (for example, the thickness not larger than 0.5 μm or furthermore not larger than 0.3 μm). Therefore, lowering in thermal conductivity due to excessively contained carbide layer 23 can be prevented and composite material 1 tends to have high thermal conductivity. When suppression of an excessive content of carbide layer 23 is desired, the content is not higher than 5 mass %, furthermore not higher than 3.5 mass %, or preferably not higher than 2.5 mass %. When improvement in heat conduction property is desired, the content may be not higher than 2.0 mass %, furthermore not higher than 1.5 mass %, not higher than 1.0 mass %, furthermore not higher than 0.9 mass %, or not higher than 0.8 mass %.

The content and/or the thickness of carbide layer 23 can be controlled not only based on the content of the metal element such as Ti described above but also based on a time period or a temperature of reaction in the manufacturing process. Therefore, an upper limit value of the content of the metal element is not absolute. For example, by reducing the time period for reaction or lowering the temperature of reaction, carbide layer 23 having a thickness smaller than a thickness of carbide layer 23 calculated based on stoichiometry of a metal element added as the source material can be formed. A remaining metal element that has not been used for forming carbide layer 23 forms an alloy as it is dissolved as a solid solution in Cu or Ag that forms metallic phase 3. Ti and/or Cr in the alloy can be precipitated by performing appropriate heat treatment (aging) as described above. Composite material 1 tends to have higher mechanical strength or heat conduction property when Ti and/or Cr are/is in a precipitated state than when Ti and/or Cr are/is in a state of a solid solution.

Substantially the entire metal element such as Ti contained in composite material 1 preferably forms carbide layer 23. In addition, the metal element may form an oxide 4 which will be described later or be precipitated in metallic phase 3.

<Size>

When non-metallic phase 2 contains particles composed of the carbon-containing material described above, the particles (including coated particles) may have an average particle size, for example, not smaller than 1 μm and not larger than 300 μm.

When the average particle size is not smaller than 1 interfaces between the particles that form non-metallic phase 2 in composite material 1 can be reduced. The interface increases thermal resistance. Therefore, as the interfaces are less, composite material 1 is higher in heat conduction property and tends to be high in thermal conductivity. As the average particle size is larger, interfaces can be reduced and heat conduction property is better. When improvement in heat conduction property is desired, the average particle size may be not smaller than 5 furthermore not smaller than 10 not smaller than 15 or not smaller than 20 μm.

When the average particle size is not larger than 300 effects below are achieved.

(1) Surface irregularities of a compact (for example, a plate material) composed of composite material 1 tend to be less and a surface property is excellent.

(2) In the manufacturing process, a compact composed of composite material 1 is readily subjected to such working as polishing or cutting.

(3) In the manufacturing process, even when particles that form non-metallic phase 2 come off during polishing or the like, a recess caused by coming off tends to be small. Therefore, the polished compact is excellent in surface property.

(4) A thin compact composed of composite material 1 is readily manufactured. When improvement in surface property, improvement in workability, or decrease in thickness is desired, the average particle size may be not larger than 250 μm, furthermore not larger than 150 or not larger than 100 μm.

So long as the average particle size is not smaller than 1 μm and not larger than 300 both of relatively fine particles and relatively coarse particles may be included. In this case, in the manufacturing process, a mold can readily densely be filled with powders of a carbon-containing material. Consequently, composite material 1 is readily enhanced in thermal conductivity and readily made smaller in coefficient of linear expansion.

The average particle size may be measured, for example, by extracting particles that form non-metallic phase 2 from composite material 1 and measuring a median diameter of the particles with a commercially available analyzer. Non-metallic phase 2 may be extracted, for example, by selectively dissolving and removing metallic phase 3 and oxide 4 which will be described later in an acid.

<Content>

The content of non-metallic phase 2 (including coated core material 20) may be, for example, not lower than 50 volume % with composite material 1 being defined as 100 volume %. In an example where non-metallic phase 2 contains a plurality of types of carbon-containing materials or a plurality of types of coated core materials 20, the content is a total content. The content of non-metallic phase 2 may be found in a procedure below. Initially, a cross-section of composite material 1 is observed with an SEM and takes a secondary electron image. A magnification in the observation is adjusted such that, for example, when non-metallic phase 2 contains particles, at least three hundred and at most four hundred particles that form non-metallic phase 2 are included in one field of view. Ten such cross-sectional images are taken (n=10). The taken images are each subjected to image processing with commercially available image analysis software. With the images subjected to image processing, an area ratio of non-metallic phase 2 in the cross-sectional images is calculated. The area ratio refers to a ratio of an area of non-metallic phase 2 to an area of one field of view. The area ratio is calculated for all fields of view (n=10) and an average value of these area ratios is further calculated. The average value of the area ratios can be regarded as the content (volume ratio) of non-metallic phase 2 contained in composite material 1.

When the content is not lower than 50 volume %, composite material 1 contains a large amount of a carbon-containing material such as diamond. Therefore, composite material 1 can have high thermal conductivity. Composite material 1 can have a smaller coefficient of linear expansion than a composite material containing only metallic phase 3. Such composite material 1 is excellent in compatibility in coefficient of linear expansion with a component of a semiconductor device described above. Therefore, this composite material 1 can be suitable for a constituent material of a heat radiation member of a semiconductor element. When improvement in heat conduction property is desired, the content may be not lower than 55 volume %, not lower than 60 volume %, or not lower than 70 volume %.

When non-metallic phase 2 is composed substantially of coated core material 20, the content (volume %) of non-metallic phase 2 includes the content (volume %) of the carbon-containing material and the content (volume %) of carbide layer 23. So long as the total content of the metal element such as Ti is 7.5 mass % or lower, the content (volume %) of carbide layer 23 is sufficiently lower than the content of coated core material 20. In other words, also in this case, composite material 1 contains a relatively large amount of carbon-containing material.

The content of non-metallic phase 2 may be, for example, not higher than 90 volume %. For example, the content of non-metallic phase 2 may be not lower than 50 volume % and not higher than 90 volume %. When the content is not higher than 90 volume %, composite material 1 contains metallic phase 3 to some extent (not lower than 10 volume %). Metallic phase 3 can bond particles that form non-metallic phase 2 to each other or can bury pores in a porous body that forms non-metallic phase 2. With metallic phase 3, the coefficient of linear expansion of composite material 1 can be prevented from becoming excessively small. Furthermore, as non-metallic phase 2 is not excessively large in amount, in the manufacturing process, core material 21 as the source material of non-metallic phase 2 tends to be infiltrated with molten source material metal 30. Therefore, production of an uninfiltrated portion is suppressed, and composite material 1 tends to more reliably be dense. When ensured metallic phase 3, denser metallic phase 3, or making of a satisfactory composite of metallic phase 3 is desired, the content may be not higher than 85 volume % or furthermore not higher than 80 volume %.

Specifications such as a shape, a size, and a content of particles or a porous body of the carbon-containing material that forms non-metallic phase 2 can be selected as appropriate. Specifications of source material powders are representatively substantially maintained as specifications of the particles. Specifications of a sintered material employed as the source material are representatively substantially maintained as specifications of the porous body. Specifications of the source material are desirably selected such that non-metallic phase 2 in composite material 1 satisfies prescribed specifications.

(Metallic Phase)

In some embodiments, metallic phase 3 may contain as the constituent material, at least 90 mass % of silver (Ag) or copper (Cu), with metallic phase 3 being defined as 100 mass %. In some embodiments, metallic phase 3 may contain as the constituent material, at least 90 mass % of Ag and Cu in total, with metallic phase 3 being defined as 100 mass %. In other words, at least 90 mass % of metallic phase 3 is composed of at least one selected from the group consisting of Ag and Cu. For example, substantially 100 mass % of metallic phase 3 may be composed of at least one selected from the group consisting of Ag and Cu. For example, at least 90 mass % and at most 100 mass % of metallic phase 3 may be composed of at least one selected from the group consisting of Ag and Cu. Specifically, metallic phase 3 may be composed of one metal selected from the group consisting of pure silver, a silver-based alloy, pure copper, a copper-based alloy, and an alloy based on a binary alloy of silver and copper, as the constituent material. In composite material 1, metallic phase 3 is mainly composed of at least one of Ag and Cu with high thermal conductivity among metal elements. Therefore, composite material 1 has high thermal conductivity.

Pure silver may representatively contain at least 99.9 mass % of Ag. Pure silver is higher in thermal conductivity than the silver-based alloy, pure copper, and the copper-based alloy. Therefore, when the constituent material of metallic phase 3 is pure silver, composite material 1 is higher in thermal conductivity than when the constituent material thereof is pure copper. In this case, when diamond is contained as non-metallic phase 2, composite material 1 is further higher in thermal conductivity.

The silver-based alloy may contain an additive element and may contain at least 90 mass % of Ag. The silver-based alloy is better in mechanical characteristics such as strength than pure silver. Therefore, when the constituent material of metallic phase 3 is the silver-based alloy, composite material 1 is excellent in mechanical characteristics such as strength. The additive element of the silver-based alloy can be selected as appropriate. A silver-based alloy of a known composition such as sterling silver 925 may be employed.

Pure copper may representatively contain at least 99.9 mass % of Cu. Pure copper is higher in thermal conductivity than the copper-based alloy. Therefore, when the constituent material of metallic phase 3 is pure copper, composite material 1 is higher in thermal conductivity than when the constituent material thereof is the copper-based alloy. Since pure copper is lighter in weight than pure silver, composite material 1 can have light weight. Furthermore, pure copper is more advantageous in mechanical strength and manufacturing cost than pure silver.

The copper-based alloy may contain an additive element and may contain at least 90 mass % of Cu. The copper-based alloy is better in mechanical characteristics such as strength than pure copper. Therefore, when the constituent material of metallic phase 3 is the copper-based alloy, composite material 1 is excellent in mechanical characteristics such as strength. The additive element of the copper-based alloy can be selected as appropriate. A copper-based alloy of a known composition may be employed.

The alloy based on the binary alloy of silver and copper may be a binary alloy of silver and copper (e.g. a eutectic alloy) or an alloy containing an additive element and containing at least 90 mass % of the binary alloy. The binary alloy of silver and copper has a low melting point. Therefore, comparing fluidity in the manufacturing process under the same infiltration temperature, the binary alloy of silver and copper is higher in fluidity than alloys other than the binary alloy. Therefore, when the constituent material of metallic phase 3 is the binary alloy, composite material 1 tends to be dense. Among constituent elements of the binary alloy having a low melting point, combination of silver and copper is highest in thermal conductivity. From a point of view of heat conduction property as well, the binary alloy is suitable for the constituent material of metallic phase 3.

(Reducing Element)

Composite material 1 in the embodiment contains a specific element such as Y, Mg, Si, B, and Zr within a range not lower than 4 mass ppm and not higher than 1.3 mass % as described above. In other words, composite material 1 further contains a specific element. The specific element is at least one selected from the group consisting of Y, Mg, Si, B, and Zr. A total content of the specific element is not lower than 0.0004 mass % and not higher than 1.3 mass %. The specific element is higher in reducing power than hydrogen in a temperature range in which composite material 1 is manufactured. Therefore, the specific element is able to reduce an oxide film present at a surface of a metal element such as Ti employed as a source material of carbide layer 23. As a result of this reduction function, the metal element reacts with carbon contained in the carbon-containing material so as to appropriately form carbide layer 23. Consequently, in composite material 1, non-metallic phase 2 and metallic phase 3 can be in intimate contact with each other, with carbide layer 23 being interposed therebetween. Details of the function of the specific element will be described in a section of an infiltration step in the manufacturing method.

Since Y and Mg in particular are readily bonded to oxygen than Ti, they tend to extremely satisfactorily function as a reducing agent for Ti. Among these, Mg readily diffuses in a vapor state in the temperature range in which composite material 1 is manufactured, and exhibits extremely satisfactory reduction property.

Y, Si, Zr, or B readily bonds to carbon. Therefore, these elements are effective in promoting infiltration between the carbon-containing material and source material metal 30 in a molten state, although the effect is not as high as that of Ti or Cr. Therefore, these elements are less likely to adversely affect infiltrative capability even when they are added as the reducing agent in an amount large to some extent in the manufacturing process.

B reduces Ti to form a glassy substance when B itself is oxidized. This glassy substance has a property to dissolve other oxides. Therefore, B promotes destruction of a film of an oxide of a metal element such as Ti or Cr.

Fine powders of Si are readily available, and in addition, Si is easy to handle and high in safety. Therefore, Si is readily added in a form of fine powders, and tends to spread evenly in a metal element such as Ti or Cr. In this regard, Si tends to achieve a high reduction effect.

When the content of the specific element described above is equal to or higher than 4 mass ppm (0.0004 mass %), it is expected that the specific element has satisfactorily functioned as the reducing agent in the manufacturing process.

Consequently, it is expected that carbide layer 23 has appropriately been formed and denseness or making of a composite has satisfactorily been achieved. As the content is higher, the reduction function is more reliably performed and carbide layer 23 is more reliably formed. Consequently, composite material 1 in which non-metallic phase 2 and metallic phase 3 are in intimate contact with each other, with carbide layer 23 being interposed therebetween, is obtained. When the ensured reduction function and satisfactory formation of carbide layer 23 are desired, the content may be equal to or higher than 10 mass ppm (0.0010 mass %), furthermore equal to or higher than 12 mass ppm (0.0012 mass %), or equal to or higher than 20 mass ppm (0.0020 mass %).

When the content of the specific element described above is not higher than 1.3 mass %, lowering in thermal conductivity due to an excessively contained specific element is readily suppressed. Consequently, composite material 1 can have high thermal conductivity. As the content described above is lower, lowering in thermal conductivity is more readily suppressed. When suppression of lowering in thermal conductivity is desired, the content may be not higher than 1.0 mass % or furthermore not higher than 0.8 mass %. In addition, the content may be not higher than 0.68 mass %, among others not higher than 0.65 mass %, not higher than 0.50 mass %, or not higher than 0.20 mass %.

Composite material 1 may contain at least some of the specific element described above representatively as oxide 4. When the specific element forms oxide 4, it is considered that the oxide film present at the surface of the metal element such as Ti is reduced in the manufacturing process and the metal element is able to satisfactorily form carbide layer 23. It is considered that oxygen separated from the oxide film is bonded to the specific element to form oxide 4. Then, carbide layer 23 is appropriately formed, and owing to carbide layer 23, composite material 1 in which non-metallic phase 2 and metallic phase 3 are in intimate contact with each other is obtained. Furthermore, the content of oxide 4 containing the specific element is dependent on the content of the specific element. When the content of the specific element is within the range described above, lowering in thermal conductivity due to excessively contained oxide 4 is less likely. Therefore, composite material 1 can have high thermal conductivity.

From the foregoing, composite material 1 containing the specific element described above as oxide 4 can have high thermal conductivity in a stable manner even after repeatedly performed hot-cold heat cycles. In this regard, the composite material preferably contains the specific element as oxide 4.

Oxide 4 containing the specific element described above may further contain a metal element such as Ti. Oxide 4 in this case may be a composite oxide containing both of the specific element and the metal element. Alternatively, oxide 4 may be a mixture containing a plurality of types of oxides such as an oxide containing the specific element and an oxide containing the metal element.

(Measurement of Composition etc.)

A content of the metal element such as Ti in composite material 1, a content of the specific element such as Yin composite material 1, or a content of Ag or Cu in metallic phase 3 may be measured, for example, as below. Composite material 1 is dissolved in an acid. A concentration of a metal component in the obtained solution is analyzed with inductively coupled plasma (ICP). A component concentration of the metal element such as Ti or the specific element such as Y is found as a mass ratio with composite material 1 being defined as 100 mass %. The component concentration of Ag or Cu is found as a mass ratio with metallic phase 3 being defined as 100 mass %.

Whether the metal element such as Ti forms a carbide can be confirmed, for example, as below. A cross-section of composite material 1 is taken, and the cross-section is subjected to component analysis with the use of an SEM- EDX apparatus or the like. When a region where the metal element is detected substantially coincides with a region where carbon is detected as a result of analysis, the metal element may be regarded as forming a carbide.

Whether the specific element such as Y forms an oxide can be confirmed, for example, as below. A cross-section of composite material 1 is taken. The cross-section is observed with the use of an SEM, and a substance (oxide 4 in FIG. 1) except for metallic phase 3 such as Ag and non-metallic phase 2 such as coated core material 20 is extracted from an observed image. The extracted substance is subjected to component analysis with the use of EDX or the like. When the extracted substance contains the specific element and oxygen as a result of analysis, the specific element may be regarded as forming an oxide. When the extracted substance further contains the metal element such as Ti as a result of analysis, the specific element may be regarded as forming the composite oxide described above or the mixture of oxides described above.

(Thermal Characteristics)

Composite material 1 in the embodiment has high thermal conductivity as described above. For example, when non-metallic phase 2 is mainly composed of diamond and metallic phase 3 is composed of pure silver, thermal conductivity may be not lower than 600 W/m·K. Alternatively, for example, when non-metallic phase 2 is mainly composed of diamond and metallic phase 3 is composed of pure copper, thermal conductivity may be not lower than 500 W/m·K.

(Shape and Size)

A shape and a size of composite material 1 are freely selected to suit an application of composite material 1. For example, when composite material 1 is used for a heat radiation member of a semiconductor element, composite material 1 may be a flat material in a quadrangular two-dimensional shape. In this application, a two-dimensional area of the flat material may be larger than an area of a mounted component such as a semiconductor element. When composite material 1 is used for a heat radiation member, thermal resistance in a direction orthogonal to a main surface (representatively, a surface on which a heat generator (to be cooled) such as a semiconductor element is mounted) of the heat radiation member is lower as the heat radiation member composed of composite material 1 is smaller in thickness. As the heat radiation member is larger in thickness, rigidity of the heat radiation member is higher. As the heat radiation member is larger in thickness, heat from the heat generator described above more readily diffuses in a direction in parallel to the main surface (a direction along the main surface by way of example) of the heat radiation member. A thickness of the heat radiation member composed of composite material 1 is freely selected in consideration of thermal resistance in the direction orthogonal to the main surface described above, diffusion of heat in the direction in parallel to the main surface, or rigidity. The thickness may be, for example, not smaller than 0.2 mm and not larger than 10 mm, furthermore not smaller than 0.2 mm and not larger than 5 mm, or not smaller than 0.2 mm and not larger than 2 mm.

(Application)

Composite material 1 in the embodiment can suitably be used as a constituent material of a heat radiation member of a semiconductor element. Examples of semiconductor devices including the heat radiation member include various electronic devices. Specific examples include a high-frequency power device (e.g. an LDMOS), a semiconductor laser device, and a light emitting diode device. In addition, examples include a central processing unit (CPU), a graphics processing unit (GPU), a high electron mobility transistor (HEMT), a chip set, and a memory chip in various computers. In particular, composite material 1 is suitable for a constituent material of a heat radiation member of a semiconductor element generating great heat such as an SiC device or a GaN device.

[Method of Manufacturing Composite Material]

Figure 2:
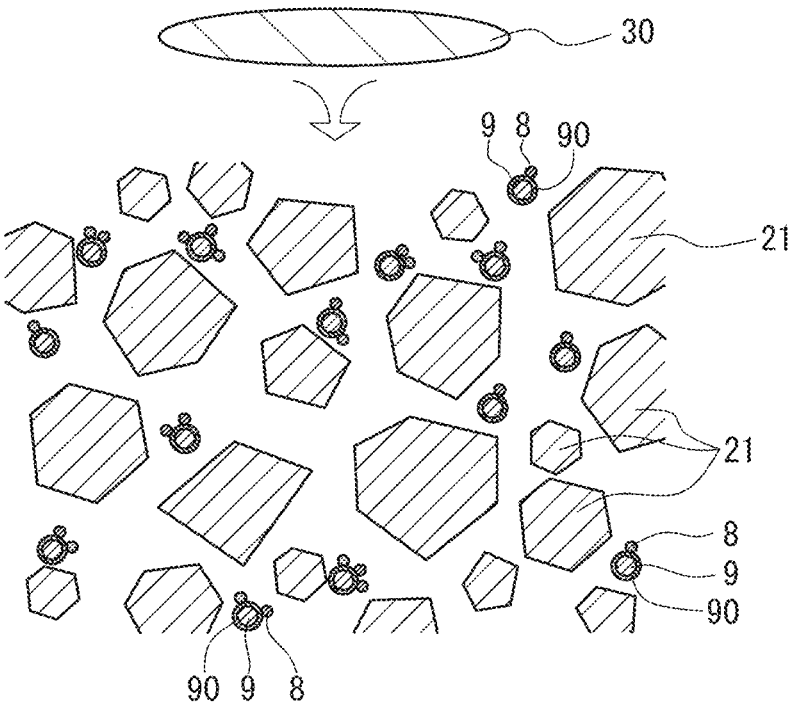
FIG. 2 is an illustrative view of a process for manufacturing the composite material in the embodiment.

A method of manufacturing a composite material will be described below with reference to FIG. 2 as appropriate.

Composite material 1 in the embodiment can be manufactured, for example, with a manufacturing method including steps below.

(Preparation Step)

The following materials are prepared:

Core material 21 composed of at least one carbon-containing material selected from the group consisting of diamond, graphite, carbon fibers, and silicon carbide;

Source material metal 30 containing at least 90 mass % of Ag or Cu or source material metal 30 containing at least 90 mass % of Ag and Cu in total;

An infiltration aid 9 containing at least one metal element selected from the group consisting of Ti, Cr, Ta, and V; and A reducing agent 8 containing at least one element selected from the group consisting of Y, Mg, Si, B, and Zr.

(Arrangement Step) Core material 21, infiltration aid 9, and reducing agent 8 are accommodated in a mold.

(Infiltration Step) Materials accommodated in the mold are infiltrated with source material metal 30 in the molten state.

In the method of manufacturing the composite material, in the infiltration step, infiltration aid 9 and reducing agent 8 are considered to perform functions as below.

The metal element such as Ti contained in infiltration aid 9 is a source material of carbide layer 23. The metal element enhances wettability of core material 21 with source material metal 30 in the molten state. Normally, however, an oxide film 90 is present at a surface of infiltration aid 9. As the surface of the infiltration aid is covered with oxide film 90, the metal element is unable to react with carbon contained in core material 21 or less likely to react therewith in a stable manner. Therefore, a thickness of carbide layer 23 tends to vary. Consequently, carbide layer 23 may not appropriately be formed and core material 21 is less likely to be wetted with source material metal 30 in the molten state. Alternatively, carbide layer 23 may excessively be formed, excessive carbide layer 23 may increase thermal resistance, and thermal conductivity of composite material 1 may lower. In contrast, in the method of manufacturing the composite material described above, reducing agent 8 containing the specific element such as Y is employed. Reducing agent 8 reduces oxide film 90. As a result of this reduction, oxide film 90 is damaged. The metal element such as Ti contained in infiltration aid 9 can diffuse from a damaged portion of oxide film 90 through source material metal 30 in the molten state and react with carbon contained in core material 21. Therefore, reducing agent 8 with a reduction function to such an extent as damaging a part of oxide film 90 allows reliable reaction between core material 21 and the metal element, which is sufficiently effective for formation of carbide layer 23. A larger area of the surface of core material 21 or preferably substantially the entire surface thereof is covered with carbide layer 23. Consequently, core material 21 is considered as being wetted with source material metal 30 in the molten state with carbide layer 23 being interposed, to thereby achieve satisfactory making of a composite and satisfactory denseness.

In composite material 1 manufactured with such a method of manufacturing a composite material, non-metallic phase 2 (core material 22) and metallic phase 3 are in intimate contact with each other with carbide layer 23 being interposed. This composite material 1 tends to be dense as a result of satisfactory making of a composite of non-metallic phase 2 and metallic phase 3. Furthermore, in composite material 1, a state of intimate contact between non-metallic phase 2 and metallic phase 3 tends to be uniform over the entire surface of core material 22. Therefore, composite material 1 tends to maintain the state of intimate contact even after repeatedly performed hot-cold heat cycles and tends to have high thermal conductivity in a stable manner. In particular, the method of manufacturing the composite material can reduce variation among products (composite materials 1) (see Test Example 1 which will be described later). Specifically, according to the method of manufacturing the composite material, composite material 1 can be mass produced such that composite material 11 is less in variation in amount of lowering in thermal conductivity among products after repeatedly performed hot-cold heat cycles, high in thermal conductivity, and less in variation in thermal conductivity.

Description will be given below for each step.

(Preparation Step)

Core material 21 to be used as a source material of non-metallic phase 2 may include particles (powders) or a porous body composed of a carbon-containing material. A size or a content of core material 21 is described in the above section <Size> and <Content> of the non-metallic phase.

A specific composition of source material metal 30 employed as a source material of metallic phase 3 is described in the above section of the metallic phase. Source material metal 30 may include metal particles (metal powders), a small piece, a wire rod, and a plate material.

Infiltration aid 9 reacts with carbon contained in core material 21 in the infiltration step and is used for forming carbide layer 23. Infiltration aid 9 may include a metal element alone such as Ti described above and a compound containing the metal element. Such a compound may readily release a constituent element (e.g. hydrogen) from the metal element so as to bond the metal element to carbon. The compound may include a hydride, a boride, a nitride, and a sulfide. When infiltration aid 9 is composed of the compound, oxide film 90 is readily prevented from being formed to a large thickness on the surface of infiltration aid 9, or the metal element is readily prevented from being oxidized before the infiltration step.

Infiltration aid 9 may be in a form of particles (powders) and a small piece. In particular, when infiltration aid 9 is in a form of powders, it tends to evenly be arranged around core material 21 which is in a form of powders or a porous body. When both of core material 21 and infiltration aid 9 are in a form of powders, they are readily mixed with each other and infiltration aid 9 is readily arranged more evenly around core material 21. As infiltration aid 9 is evenly arranged, in the infiltration step, carbon contained in core material 21 readily reacts with a metal element such as Ti contained in infiltration aid 9. Consequently, carbide layer 23 is readily satisfactorily formed. In addition, when both of them are in a form of powders, a mold is readily filled with these powders or a compact of powders is readily made. When infiltration aid 9 is in a form of powders, oxide film 90 tends to be formed on a surface of a powder particle. In the method of manufacturing a composite material described above, oxide film 90 is reduced by reducing agent 8.

Reducing agent 8 can reduce oxide film 90 that may be present at the surface of infiltration aid 9 in the infiltration step. As oxide film 90 can be damaged by reducing agent 8, a metal element such as Ti contained in infiltration aid 9 can reliably react with carbon contained in core material 21. Therefore, carbide layer 23 can be formed. Reducing agent 8 functions as an aid for forming carbide layer 23 so to speak.

Reducing agent 8 may include a specific element alone such as Y and a compound containing the specific element. The compound may preferably have high generation energy (which is called oxide generation energy below) in an oxide of a specific element. In particular, when oxide generation energy of reducing agent 8 is higher than oxide generation energy of infiltration aid 9, reducing agent 8 is expected to more reliably reduce oxide film 90. Even when oxide generation energy of reducing agent 8 is lower than oxide generation energy of infiltration aid 9, reducing agent 8 is sufficiently able to slightly damage oxide film 90 to promote reaction with carbon contained in core material 21.

Reducing agent 8 may be in a form of particles (powders) and a small piece. In particular, when reducing agent 8 is in a form of powders, it is readily evenly arranged around infiltration aid 9. When all three of core material 21, infiltration aid 9, and reducing agent 8 are in the form of powders, they are readily mixed with one another, and reducing agent 8 can evenly be arranged around infiltration aid 9 and additionally infiltration aid 9 can evenly be arranged around core material 21. As reducing agent 8 is evenly arranged, in the infiltration step, reducing agent 8 can reduce oxide film 90 of infiltration aid 9 to more reliably damage the oxide film. Consequently, carbide layer 23 can satisfactorily be formed. In addition, when three of them are in the form of powders, a mold is readily filled with these powders or a compact of powders is readily made.

<Size>

Source material metal 30 is dissolved to lose its original shape at the same time as infiltration thereof. Therefore, a shape or a size of source material metal 30 can freely be selected within a range in which the source material metal is readily used. For example, powders having an average particle size approximately not smaller than 1 μm and not larger than 150 μm may be employed as source material metal 30.

A size of infiltration aid 9 or reducing agent 8 is freely selected in accordance with a size of core material 21. For example, powders having an average particle size at most half the average particle size of core material 21 may be employed as infiltration aid 9. Alternatively, for example, powders having an average particle size not smaller than 0.5 μm and not larger than 20 μm may be employed as infiltration aid 9. For example, powders having an average particle size approximately not smaller than 0.1 μm and not larger than 20 μm may be employed as reducing agent 8. When the average particle size of reducing agent 8 is smaller than the average particle size of infiltration aid 9, reducing agent 8 readily spreads around infiltration aid 9. The average particle size of powders of each of source material metal 30, infiltration aid 9, and reducing agent 8 may be expressed as the median diameter described above.

(Arrangement Step)

Core material 21, infiltration aid 9, and reducing agent 8 are accommodated in a mold in a prescribed shape. When these are in the form of powders as described above, a mold may be filled individually with them, or mixed powders may be prepared in advance and a mold may be filled therewith. Alternatively, a powder compact may be made of mixed powders and the powder compact may be accommodated in a mold. The powder compact may be manufactured, for example, by press-forming. In addition, when core material 21 is in a form of a porous body, the porous body may be accommodated in a mold and thereafter the mold may be filled with powders of infiltration aid 9 and reducing agent 8.

An amount of addition of infiltration aid 9 and an amount of addition of reducing agent 8 may be adjusted such that a content of a metal element such as Ti in composite material 1 and a content of a specific element such as Y in composite material 1 are within the specific ranges described above. In this case, lowering in thermal conductivity due to excessively contained metal element or specific element preferably tends to readily be suppressed. In particular, by using reducing agent 8, composite material 1 tends to have high thermal conductivity as will be described below.

By adding a sufficiently large amount of infiltration aid 9 in consideration of interference with reaction by oxide film 90, carbide layer 23 is readily formed. Excessive addition of infiltration aid 9, however, may cause a remaining metal element (which may include oxide film 90) in composite material 1 or increase in thickness of carbide layer 23. Then, thermal conductivity may lower. In contrast, with the use of reducing agent 8, in added infiltration aid 9, a ratio of infiltration aid 9 that actually reacts can be stabilized. Therefore, with the use of reducing agent 8, an amount of addition of infiltration aid 9 does not have to be excessive large. Thus, use of reducing agent 8 is less likely to cause lowering in thermal conductivity due to a remaining metal element such as Ti described above or increase in thickness of carbide layer 23 while carbide layer 23 is included neither excessively nor insufficiently.

(Infiltration Step)

The main operation in this step is to form a composite of core material 21 and source material metal 30. Specifically, the mold described above is heated to a prescribed temperature to melt source material metal 30. Materials accommodated in the mold described above (core material 21, infiltration aid 9, and reducing agent 8) and source material metal 30 in the molten state are brought in contact with each other to allow penetration of source material metal 30 in the molten state into the accommodated materials. Then, core material 21 is infiltrated with source material metal 30 in the molten state. The temperature in the infiltration step is selected in accordance with a composition of source material metal 30.

An atmosphere in the infiltration step is preferably a low-oxidative atmosphere such as a vacuum atmosphere or an inert atmosphere. The low-oxidative atmosphere contributes to less oxidation of a source material and in particular a metal element such as Ti contained in infiltration aid 9. The vacuum atmosphere may be a low-pressure atmosphere lower than the atmospheric pressure. The pressure of the atmosphere may be, for example, not higher than 1 Pa. The inert atmosphere may be an argon atmosphere and a nitrogen atmosphere.

[Main Functions and Effects]

Composite material 1 in the embodiment is less in lowering in thermal conductivity and high in thermal conductivity in a stable manner even after repeated hot-cold heat cycles. This effect will specifically be described in a test example below.

Test Example 1

A flat material composed of a composite material containing diamond and pure silver or pure copper is made and thermal conductivity before and after hot-cold heat cycles is examined.

(Making of Sample)

A flat material having a quadrangular two-dimensional shape and a thickness of 1.0 mm is made. The following is prepared as source materials of the composite material.

Source material of non-metallic phase: diamond powders having an average particle size selected from average particle sizes not smaller than 20 μm and not larger than 30 μm Source material of metallic phase (source material metal): pure silver powders (denoted as Ag in Table 1) or pure copper powders (denoted as Cu in Table 1) having an average particle size selected from average particle sizes not smaller than 1 μm and not larger than 10 μm Infiltration aid: powders of an element or a compound shown in the field of Type in Table 1, the powders having an average particle size selected from average particle sizes not smaller than 5 μm and not larger than 10 μm Reducing agent: powders of an element shown in the field of Type in Table 1 having an average particle size selected from average particle sizes not smaller than 3 μm and not larger than 5 μm The average particle size of powders described above indicates the median diameter. The median diameter can be measured, for example, with a laser diffraction/scattering particle size distribution analyzer. For example, a commercially available laser diffraction/scattering particle size distribution analyzer include MT3300 EX II (manufactured by Microtrac GmbH) may be used.

A content (volume %) of diamond powders is shown in the field of "Volume Ratio" of Non-Metal in Table 1. The content (volume %) shown in Table 1 represents a ratio of a volume with the flat material of the composite material being defined as 100 volume %. This volume ratio is substantially equal to the ratio of the volume of the non-metallic phase in the flat material of the composite material.

Table 1 shows an amount of addition (mass %) of the infiltration aid and an amount of addition (mass %) of the reducing agent. Amount of Addition (mass %) shown in Table 1 represents a ratio of a mass to a mass of diamond powders with the mass of diamond powders being defined as 100 mass %. The amount of addition of the reducing agent being 0 mass % means that no reducing agent is added.

A mold is filled with diamond powders, powders of the infiltration aid, powders of the reducing agent, and pure silver powders or pure copper powders which are the source material metal. This mold is heated to a prescribed temperature to melt the source material metal. Then, accommodated materials are infiltrated with the molten source material metal in the argon atmosphere at one atmospheric pressure. In this step, the flat material of the composite material is obtained.

TABLE 1

| Sample No. | Metal Type | Non-Metal Type | Volume Ratio Volume % | Infiltration Aid Type | Amount of Addition Mass % | Reducing Agent Type | Amount of Addition Mass % |
|---|---|---|---|---|---|---|---|
| 1 | Ag | Diamond | 60 | Ti | 2.0 | — | 0 |
| 2 | Ag | Diamond | 60 | Ti | 2.0 | Y | 0.0012 |
| 3 | Ag | Diamond | 60 | Ti | 2.0 | Y | 0.004 |
| 4 | Ag | Diamond | 60 | Ti | 2.0 | Y | 0.012 |
| 5 | Ag | Diamond | 60 | Ti | 2.0 | Y | 0.02 |
| 6 | Ag | Diamond | 60 | Ti | 2.0 | Y | 0.04 |
| 7 | Ag | Diamond | 60 | Ti | 2.0 | Y | 0.2 |
| 8 | Ag | Diamond | 60 | Ti | 2.0 | Y | 0.4 |
| 9 | Ag | Diamond | 60 | Ti | 2.0 | Y | 2 |
| 10 | Ag | Diamond | 60 | Ti | 2.0 | Y | 4 |
| 11 | Ag | Diamond | 60 | Ti | 2.0 | Y | 12 |
| 12 | Ag | Diamond | 60 | Ti | 2.0 | Mg | 0.012 |
| 13 | Ag | Diamond | 60 | Ti | 2.0 | Mg | 0.04 |
| 14 | Ag | Diamond | 60 | Ti | 2.0 | Zr | 0.012 |
| 15 | Ag | Diamond | 60 | Ti | 2.0 | Zr | 0.04 |
| 16 | Ag | Diamond | 60 | Ti | 2.0 | Si | 0.012 |
| 17 | Ag | Diamond | 60 | Ti | 2.0 | Si | 0.04 |
| 18 | Ag | Diamond | 60 | Ti | 2.0 | B | 0.012 |
| 19 | Ag | Diamond | 60 | Ti | 2.0 | B | 0.04 |
| 20 | Ag | Diamond | 60 | Ti | 2.0 | B | 0.2 |
| 21 | Ag | Diamond | 60 | Ti | 2.0 | B | 0.4 |
| 22 | Ag | Diamond | 60 | Ti | 2.0 | B | 2 |
| 23 | Ag | Diamond | 60 | $TiH_2$ | 2.0 | — | 0 |
| 24 | Ag | Diamond | 60 | $TiH_2$ | 2.0 | Y | 0.012 |
| 25 | Ag | Diamond | 60 | Cr | 2.0 | — | 0 |
| 26 | Ag | Diamond | 60 | Cr | 2.0 | Y | 0.012 |
| 27 | Ag | Diamond | 60 | Ta | 2.0 | — | 0 |
| 28 | Ag | Diamond | 60 | Ta | 2.0 | Y | 0.012 |
| 29 | Ag | Diamond | 60 | V | 2.0 | — | 0 |
| 30 | Ag | Diamond | 60 | V | 2.0 | Y | 0.012 |
| 31 | Ag | Diamond | 50 | Ti | 2.0 | Y | 0.04 |
| 32 | Ag | Diamond | 70 | Ti | 2.0 | Y | 0.04 |
| 33 | Ag | Diamond | 85 | Ti | 2.0 | Y | 0.04 |
| 34 | Cu | Diamond | 60 | Ti | 2.0 | — | 0 |
| 35 | Cu | Diamond | 60 | Ti | 2.0 | Y | 0.0012 |
| 36 | Cu | Diamond | 60 | Ti | 2.0 | Y | 0.012 |
| 37 | Cu | Diamond | 60 | Ti | 2.0 | Y | 0.02 |
| 38 | Cu | Diamond | 60 | Ti | 2.0 | Y | 0.2 |
| 39 | Cu | Diamond | 60 | Ti | 2.0 | Y | 4 |
| 40 | Cu | Diamond | 60 | Ti | 2.0 | Y | 12 |
| 41 | Cu | Diamond | 60 | Ti | 2.0 | Mg | 0.02 |
| 42 | Cu | Diamond | 60 | Ti | 2.0 | Zr | 0.02 |
| 43 | Cu | Diamond | 60 | Ti | 2.0 | Si | 0.02 |
| 44 | Cu | Diamond | 60 | Ti | 2.0 | B | 0.02 |
| 45 | Cu | Diamond | 60 | Ti | 2.0 | B | 0.2 |
| 46 | Cu | Diamond | 60 | Ti | 2.0 | B | 0.4 |
| 47 | Cu | Diamond | 60 | Ti | 2.0 | B | 2 |

(Thermal Characteristics)

<Thermal Conductivity in State where Hot-Cold Heat Cycles have not been Performed>

One hundred flat materials of each sample are prepared, and thermal conductivity (W/(m·K)) of the flat material of the composite material of each made sample is measured. An average value and a standard deviation of thermal conductivity of one hundred flat materials of each sample are shown in the field of Thermal Conductivity in Table 2. In measurement, one hundred flat materials of each sample are not subjected to a hot-cold heat cycle test which will be described later. Thermal conductivity (W/m·K) is measured by the flash method with the use of a commercially available measurement apparatus (NETZSCH LFA447 here). Conditions for measurement are in conformity with ASTM E1461-13 "Standard Test Method for Thermal Diffusivity by the Flash Method."

<Thermal Conductivity Before and After Hot-Cold Heat Cycles>

The flat material of the composite material of each made sample is subjected to hot-cold heat cycles below to examine variation in thermal conductivity before and after the hot-cold heat cycles. Measurement and component analysis which will be described later are conducted for one hundred flat materials of each sample described above.

<<Conditions in Hot-Cold Heat Cycles>>

Such an operation that the flat material of each sample is immersed for ten minutes in a test solution held at −60° C. and thereafter immersed for ten minutes in a test solution held at 150° C. is defined as one cycle. This hot-cold heat cycle is performed one thousand times. A fluorine-based inert solution ("Galden®" or "Fluorinert™" can be used as the test solution.

After one thousand hot-cold heat cycles described above are performed, thermal conductivity is measured. Thermal conductivity (W/m·K) of one hundred flat materials is found for each sample.

Thermal conductivity retention (%) after the hot-cold heat cycles with respect to thermal conductivity of the flat material of each sample before the hot-cold heat cycles, that is, the flat material of each sample not subjected to the hot-cold heat cycles, is calculated. Thermal conductivity retention (%) is calculated as (thermal conductivity after one thousand cycles/thermal conductivity before hot-cold heat cycles)×100. An average value and a standard deviation of thermal conductivity retention (%) of the flat material of each sample are calculated. Specifically, thermal conductivity retention (%) of one hundred flat materials for each sample is calculated to calculate the average value and the standard deviation of values of one hundred flat materials. Results are shown in the field of Resistance to Hot-Cold Heat Cycle in Table 2.

(Component Analysis)

A content (mass %) of a metal element contained in the infiltration aid and a content (mass %) of an element contained in the reducing agent are measured for the flat material of the composite material of each sample and Table 2 shows results of measurement. A content of each of Ti, Cr, Ta, and V as the metal element contained in the infiltration aid is measured. A content of each of Y, Mg, Zr, Si, and B as the element contained in the reducing agent is measured. A measurement method will be described below.

A surface of the flat material of the composite material of each sample is ground with the use of a diamond grindstone to remove a substance attached to a surface of the flat material. Each of a front surface and a rear surface of the flat material is ground by 50 μm. Then, using nitric acid and an autoclave, the flat material is completely dissolved in the acid. An obtained solution is analyzed with an ICP emission spectrometer. A mass ratio (mass %) of a metal element such as Ti and a mass ratio (mass %) of a specific element such as Y are determined with the composite material of each sample being defined as 100 mass % and Table 2 shows results.

TABLE 2

| Sample | Component Analysis Value | | | | Thermal Conductivity | | Resistance to Hot-Cold Heat Cycles | |
|---|---|---|---|---|---|---|---|---|
| | | | | | Average Value | Standard | Average Value | Standard |
| No. | Type | Mass % | Type | Mass % | W/m · K | Deviation | % | Deviation |
| 1 | Ti | 0.67 | — | — | 620 | 20.3 | 95.6 | 2.4 |
| 2 | Ti | 0.67 | Y | 0.0004 | 629 | 17.4 | 96.2 | 2.2 |
| 3 | Ti | 0.65 | Y | 0.0013 | 633 | 14.2 | 96.5 | 2.0 |
| 4 | Ti | 0.67 | Y | 0.0040 | 640 | 12.1 | 97.1 | 1.4 |
| 5 | Ti | 0.67 | Y | 0.0066 | 645 | 10.2 | 97.2 | 0.9 |
| 6 | Ti | 0.66 | Y | 0.0136 | 644 | 10.4 | 97.2 | 0.8 |
| 7 | Ti | 0.65 | Y | 0.0675 | 639 | 10.7 | 97.3 | 0.9 |
| 8 | Ti | 0.67 | Y | 0.136 | 632 | 10.5 | 97.1 | 1.0 |
| 9 | Ti | 0.67 | Y | 0.656 | 626 | 10.6 | 97.2 | 0.9 |
| 10 | Ti | 0.67 | Y | 1.33 | 620 | 10.5 | 97.3 | 1.0 |
| 11 | Ti | 0.67 | Y | 4.07 | 588 | 10.3 | 97.4 | 0.9 |
| 12 | Ti | 0.66 | Mg | 0.0039 | 635 | 12.4 | 96.8 | 1.6 |
| 13 | Ti | 0.67 | Mg | 0.0133 | 639 | 10.4 | 97.0 | 0.9 |
| 14 | Ti | 0.68 | Zr | 0.0040 | 639 | 12.1 | 97.2 | 1.4 |
| 15 | Ti | 0.65 | Zr | 0.0137 | 643 | 10.1 | 97.3 | 0.8 |
| 16 | Ti | 0.67 | Si | 0.0039 | 632 | 12.7 | 96.5 | 1.8 |
| 17 | Ti | 0.66 | Si | 0.0135 | 636 | 10.5 | 96.7 | 1.0 |
| 18 | Ti | 0.68 | B | 0.0041 | 633 | 12.6 | 96.5 | 1.7 |
| 19 | Ti | 0.67 | B | 0.0132 | 637 | 10.6 | 96.6 | 1.1 |
| 20 | Ti | 0.66 | B | 0.0667 | 632 | 10.7 | 96.5 | 1.2 |
| 21 | Ti | 0.66 | B | 0.135 | 625 | 10.5 | 96.5 | 1.0 |
| 22 | Ti | 0.67 | B | 0.658 | 621 | 10.6 | 96.3 | 1.1 |
| 23 | Ti | 0.67 | — | — | 638 | 14.3 | 96.4 | 1.9 |
| 24 | Ti | 0.68 | Y | 0.0040 | 656 | 8.7 | 97.9 | 0.6 |
| 25 | Cr | 0.68 | — | — | 621 | 20.5 | 95.6 | 2.4 |
| 26 | Cr | 0.66 | Y | 0.0039 | 640 | 10.2 | 97.1 | 0.9 |
| 27 | Ta | 0.66 | — | — | 623 | 20.6 | 95.5 | 2.5 |
| 28 | Ta | 0.68 | Y | 0.0039 | 638 | 10.3 | 97.0 | 0.8 |
| 29 | V | 0.65 | — | — | 622 | 20.6 | 95.4 | 2.3 |
| 30 | V | 0.66 | Y | 0.0041 | 641 | 10.2 | 97.0 | 0.9 |
| 31 | Ti | 0.67 | Y | 0.0134 | 615 | 10.2 | 97.2 | 0.9 |
| 32 | Ti | 0.68 | Y | 0.0131 | 681 | 10.1 | 97.2 | 0.9 |
| 33 | Ti | 0.67 | Y | 0.0135 | 743 | 10.1 | 97.1 | 0.9 |
| 34 | Ti | 0.67 | — | — | 553 | 20.3 | 95.6 | 2.5 |
| 35 | Ti | 0.68 | Y | 0.0004 | 568 | 17.3 | 96.3 | 2.1 |
| 36 | Ti | 0.66 | Y | 0.0040 | 576 | 11.9 | 96.9 | 1.5 |
| 37 | Ti | 0.67 | Y | 0.0065 | 577 | 10.1 | 97.3 | 0.9 |
| 38 | Ti | 0.66 | Y | 0.0669 | 575 | 10.3 | 97.2 | 0.8 |
| 39 | Ti | 0.67 | Y | 1.32 | 554 | 10.2 | 97.2 | 0.9 |
| 40 | Ti | 0.68 | Y | 4.01 | 518 | 10.1 | 97.3 | 0.9 |
| 41 | Ti | 0.68 | Mg | 0.0068 | 570 | 10.6 | 97.0 | 1.0 |
| 42 | Ti | 0.68 | Zr | 0.0067 | 577 | 10.0 | 97.2 | 0.9 |
| 43 | Ti | 0.66 | Si | 0.0068 | 564 | 10.8 | 96.7 | 1.0 |
| 44 | Ti | 0.66 | B | 0.0068 | 569 | 10.7 | 96.8 | 1.0 |
| 45 | Ti | 0.67 | B | 0.0662 | 567 | 10.8 | 96.7 | 1.0 |
| 46 | Ti | 0.65 | B | 0.137 | 564 | 10.8 | 96.8 | 1.1 |
| 47 | Ti | 0.66 | B | 0.679 | 558 | 10.7 | 96.8 | 1.0 |

Samples Nos. 1 to 33 are each a sample of the composite material in which the metallic phase is composed of pure silver.

Samples Nos. 34 to 47 are each a sample of the composite material in which the metallic phase is composed of pure copper.

Samples Nos. 2 to 22, 24, 26, 28, 30 to 33, and 35 to 47 are each a sample containing one element selected from the group consisting of Y, Mg, Zr, Si, and B.

Samples Nos. 1, 23, 25, 27, 29, and 34 are each a sample containing no specific element such as Y.

Initially, attention is paid to samples Nos. 1 to 11 in Table 2. Each of samples Nos. 2 to 11 containing Y is smaller in standard deviation of thermal conductivity, or less in variation in thermal conductivity so to speak, than sample No. 1 containing no Y. In particular, samples Nos. 2 to 9 are higher in average value of thermal conductivity (less in lowering in thermal conductivity) than samples Nos. 1 and 10 and 11. Furthermore, samples Nos. 2 to 9 are higher in average value of resistance to hot-cold heat cycles and smaller in standard deviation than sample No. 1. Such samples Nos. 2 to 9 are stable in thermal conductivity at certain magnitude even after repeatedly performed hot-cold heat cycles. Reasons therefor may be, for example, as below.

The oxide film that may be present at the surface of the infiltration aid (Ti here) is reduced by Y in the manufacturing process and the oxide film is damaged. Consequently, carbon contained in diamond and Ti reliably react with each other and the carbide layer (a TiC layer here) can be formed in a stable manner. Owing to the carbide layer, diamond is well wetted with silver and production of an uninfiltrated portion can be lessened. Without damage to the oxide film, the infiltration aid is locally deficient and the carbide layer is not sufficiently formed. Consequently, production of an uninfiltrated portion (void) that adversely affects thermal conductivity is likely. Samples Nos. 2 to 11 may be more stable in amount of the uninfiltrated portion at a low level than sample No. 1. Consequently, samples Nos. 2 to 11 are each smaller in standard deviation of thermal conductivity than sample No. 1.

In particular, samples Nos. 2 to 9 improved not only in resistance to hot-cold heat cycles but also in average value of thermal conductivity because the amount of addition of Y may be optimal. As the amount of addition of Y is optimal, there is a small amount of residue of Y that may be a factor for interference with heat conduction and the effect of decrease in uninfiltrated portion owing to addition of Y may overcome interference with heat conduction by the residue of Y.

In contrast, sample No. 10 did not improve in average value of thermal conductivity and improved only in resistance to hot-cold heat cycles because the amount of addition of Y may be relatively large. As the amount of addition of Y is relatively large, interference with heat conduction by the residue of Y and the effect of decrease in uninfiltrated portion by addition of Y may be on a par with each other. Sample No. 11 lowered in average value of thermal conductivity although improved in resistance to hot-cold heat cycles, because the amount of addition of Y may be excessive. Interference with heat conduction by the residue of Y due to an excessive amount of addition of Y may overcome the effect of decrease in uninfiltrated portion by addition of Y.

In the manufacturing process, Y reduces and damages the oxide film that may be present at the surface of the infiltration aid (Ti here) so that carbon contained in diamond and Ti reliably react with each other. Consequently, the carbide layer (the TiC layer here) may be formed in a stable manner. As the carbide layer is satisfactorily formed, each diamond particle may firmly come in intimate contact with silver in a stable manner. Owing to this intimate contact, even after repeated hot-cold heat cycles, a state of intimate contact between diamond particles (non-metallic phase) covered with the carbide layer and silver (metallic phase) may readily be maintained. In sample No. 1 to which Y is not added, the infiltration aid may locally be deficient due to the oxide film as described above and there may be a location where the carbide layer is not sufficiently formed. At the location where the carbide layer is not sufficiently formed, an interface between the non-metallic phase and the metallic phase may be weak. Therefore, as a result of repeated hot-cold heat cycles, the non-metallic phase and the metallic phase tend to separate from each other at that location. This separation may cause the decrease in the average value of thermal conductivity after the hot-cold heat cycles and the increase in the variation in thermal conductivity.

Each of samples Nos. 12 to 22 containing Mg or the like is higher in average value of thermal conductivity and also small in standard deviation of thermal conductivity and additionally larger in average value of resistance to hot-cold heat cycles and also smaller in standard deviation of resistance to hot-cold heat cycles than sample No. 1. It is thus considered that Mg, Zr, Si, and B instead of Y are also effective similarly to Y.

Then, attention is paid to samples Nos. 34 to 47 in Table 2. Samples Nos. 35 to 47 in which the metallic phase is composed of pure copper and contains a specific element such as Y are each smaller in standard deviation of thermal conductivity, higher in average value of resistance to hot-cold heat cycles, and also smaller in standard deviation of resistance to hot-cold heat cycles than sample No. 34 containing no specific element. In particular, samples Nos. 35 to 38 and 41 to 47 optimal in content of the specific element are larger in average value of thermal conductivity than samples Nos. 39 and 40. It is thus concluded that, even when the metallic phase is composed of pure copper, the effect of improvement in characteristics obtained by adding the reducing agent such as Y is obtained as in an example where the metallic phase described above is composed of pure silver. The reason why the average value of thermal conductivity is low in samples Nos. 39 and 40 is considered as the same as the reason for samples Nos. 10 and 11 described above.

The foregoing discussions may demonstrate that the composite material high in thermal conductivity in a stable manner even after repeated hot-cold heat cycles preferably contains a specific element such as Y and a content thereof is not lower than 4 mass ppm (0.0004 mass %) and lower than 1.34 mass % and particularly not higher than 1.3 mass %. The content of the specific element not lower than 10 mass ppm or furthermore not lower than 12 mass ppm is preferred because thermal conductivity and resistance to hot-cold heat cycles may be higher. In this case, the standard deviation of thermal conductivity and also the standard deviation of resistance to hot-cold heat cycles may be small and variation may be less. The content of the specific element not lower than 15 mass ppm and not higher than 0.5 mass % is preferred because thermal conductivity is higher. The content of the specific element not lower than 30 mass ppm and not higher than 0.2 mass % or furthermore not higher than 0.1 mass % or not higher than 0.08 mass % may further be preferred. It may demonstrate that, when the metallic phase is composed of pure silver, the content of the specific element not lower than 0.010 mass % and not higher than 0.020 mass % is preferred because thermal conductivity is further higher. It can be seen that the metallic phase composed of pure silver is higher in thermal conductivity than the metallic phase composed of pure copper and the composite material high in thermal conductivity not lower than 600 W/m·K may be provided.

Attention is now paid to samples Nos. 23 and 24. Samples Nos. 23 and 24 are samples containing $TiH_2$ as the infiltration aid as shown in Table 1.

Sample No. 1 is initially compared with sample No. 23. Based on comparison, $TiH_2$ as the infiltration aid is better in all of thermal conductivity, the standard deviation of thermal conductivity, resistance to hot-cold heat cycles, and the standard deviation of resistance to hot-cold heat cycles than Ti as the infiltration aid. The reason why such a result is obtained may be an effect of reduction by $H_2$ contained in $TiH_2$.

Sample No. 4 is then compared with sample No. 23. Based on comparison, Ti as the infiltration aid with the addition of the specific element such as Y as the reducing agent is better in all of thermal conductivity, the standard deviation of thermal conductivity, resistance to hot-cold heat cycles, and the standard deviation of resistance to hot-cold heat cycles than $TiH_2$ as the infiltration aid with the addition of no specific element. Such a result suggests that the effect of reduction by Y is higher than the effect of reduction by $H_2$ contained in $TiH_2$.

Furthermore, sample No. 23 is compared with sample No. 24. Based on comparison, $TiH_2$ as the infiltration aid with the addition of the specific element such as Y as the reducing agent achieves improvement in all of thermal conductivity, the standard deviation of thermal conductivity, resistance to hot-cold heat cycles, and the standard deviation of resistance to hot-cold heat cycles, as compared with an example in which no specific element is added. One of reasons for such a result may be a function of both of $H_2$ contained in $TiH_2$ and Y in the reducing agent toward improvement in characteristics.

Attention is now paid to samples Nos. 25 to 30. Samples Nos. 25 to 30 are samples containing one selected from the group consisting of Cr, Ta, and V as the infiltration aid. Samples Nos. 26, 28, and 30 containing Y are larger in average value of thermal conductivity and also smaller in standard deviation of thermal conductivity and additionally larger in average value of resistance to hot-cold heat cycles and also smaller in resistance to hot-cold heat cycles than samples Nos. 25, 27, and 29 containing no Y, respectively. It is thus considered that use of the specific element such as Y even in the case of use of Cr, Ta, and V instead of Ti as the infiltration aid achieves the effect of reduction by the specific element and satisfactory formation of the carbide layer containing Cr involved with reduction as in the case of Ti. Considering the case of Cr or the like and the case of Ti described above together, the content not lower than 0.1 mass % and not higher than 7.5 mass % of the metal element such as Ti, Cr, Ta, and V in the composite material may be preferred. Furthermore, the content not lower than 0.1 mass % and not higher than 2.5 mass % or furthermore not lower than 0.3 mass % and not higher than 1.0 mass % of the metal element may be preferred.

Attention is now paid to samples Nos. 31 to 33. These samples are different from sample No. 4 in content of diamond. It can be seen that thermal conductivity is higher in the order of samples Nos. 31, 4, 32, and 33. It may demonstrate that the effect of reduction by the specific element such as Y is exhibited regardless of the content of diamond and exhibited toward improvement in characteristics. It may demonstrate that a composite material higher in thermal conductivity can be obtained by increasing the content of a carbon-containing material such as diamond.

A cross-section of the flat material of the composite material of each sample is subjected to surface analysis with the use of the SEM-EDX apparatus, and an area including the metal element such as Ti, Cr, Ta, or V is compared with an area including carbon (C). When there is a location where these areas overlap with each other, the metal element in that overlapping location can be regarded as forming the carbide layer. In the cross-sectional SEM image described above, a substance other than the non-metallic phase (diamond and the carbide layer here) and the metallic phase (pure silver or pure copper here) is extracted and subjected to component analysis with the use of the SEM-EDX apparatus. When an element such as Y, Mg, Zr, Si, and B and oxygen are detected as a result of component analysis, an element such as Y can be regarded as forming an oxide. When a metal element such as Ti is detected from the substance, some of the metal element may not form the carbide layer in the manufacturing process but may form the oxide.

The foregoing discussions may demonstrate that the composite material satisfying conditions below is less in variation in characteristics and is high in thermal conductivity in a stable manner even after repeated hot-cold heat cycles.

(Condition) The metallic phase is mainly composed of Ag or Cu. The non-metallic phase contains a carbon-containing material such as diamond. The composite material includes a carbide layer containing a metal element such as Ti at a surface of the carbon-containing material. The composite material contains a specific element such as Y within a specific range.

[Additional Aspect]

(Additional Aspect 1)

A composite material includes a metallic phase and a non-metallic phase, the metallic phase contains at least 90 mass % of Ag or Cu or contains at least 90 mass of Ag and Cu in total with the metallic phase being defined as 100 mass %, the non-metallic phase includes a coated core material, the coated core material includes a core material and a carbide layer that covers at least a part of a surface of the core material, a constituent material of the core material contains at least one carbon-containing material selected from the group consisting of diamond, graphite, carbon fibers, and silicon carbide, the constituent material of the carbide layer contains a carbide of at least one metal element selected from the group consisting of Ti, Cr, Ta, and V, and the composite material contains at least 4 mass ppm and at most 1.3 mass % of at least one element selected from the group consisting of Y, Mg, Si, B, and Zr in total with the composite material being defined as 100 mass %.

(Additional Aspect 2)

The composite material described in Additional Aspect 1 contains at least some of the element as an oxide.

(Additional Aspect 3)

The composite material described in Additional Aspect 1 or 2 contains at least 0.1 mass % and at most 7.5 mass % of the metal element in total with the composite material being defined as 100 mass %.

(Additional Aspect 4)

In the composite material described in any one of Additional Aspects 1 to 3, a content of the non-metallic phase is not lower than 50 volume % with the composite material being defined as 100 volume %.

The present invention is not limited to these examples, but is defined by the terms of the claims. The present invention is intended to include any modifications within the scope and meaning equivalent to the terms of the claims. For example, in Test Example 1, a composition of a metallic phase in a composite material, a composition, a size (particle size), and a content of a non-metallic phase, a composition and an amount of addition of an infiltration aid, a composition and an amount of addition of a reducing agent, and a condition for infiltration can freely be modified.

REFERENCE SIGNS LIST

1 composite material; 2 non-metallic phase; 3 metallic phase; 20 coated core material; 21, 22 core material; 23 carbide layer; 30 source material metal; 4 oxide; 8 reducing agent; 9 infiltration aid; 90 oxide film

The invention claimed is:

1. A composite material comprising:

a metallic phase;

a non-metallic phase; and a specific element, wherein at least 90 mass % of the metallic phase is composed of at least one selected from the group consisting of Ag and Cu, the non-metallic phase includes a coated core material, the coated core material includes a core material and a carbide layer that covers at least a part of a surface of the core material, the core material contains at least one carbon-containing material selected from the group consisting of diamond, graphite, carbon fibers, and silicon carbide, the carbide layer contains a carbide of at least one metal element selected from the group consisting of Ti, Cr, Ta, and V, the specific element is at least one selected from the group consisting of Y and Mg, the specific element is in a form of particles, and a total content of the specific element is not lower than 0.0004 mass % and not higher than 1.3 mass %.

2. The composite material according to claim 1, comprising at least some of the specific element as an oxide.

3. The composite material according to claim 1, wherein a total content of the metal element is not lower than 0.1 mass % and not higher than 7.5 mass %.

4. The composite material according to claim 1, wherein a content of the non-metallic phase is not lower than 50 volume %.

5. The composite material according to claim 1, wherein a content of the non-metallic phase is not lower than 50 volume % and not higher than 90 volume %.

6. The composite material according to claim 1, comprising at least some of the specific element as an oxide, wherein a total content of the metal element is not lower than 0.1 mass % and not higher than 7.5 mass %, and a content of the non-metallic phase is not lower than 50 volume % and not higher than 90 volume %.

7. The composite material according to claim 1, wherein the carbide layer contains Ti.

* * * * *